US006011519A

United States Patent [19]

Sadler et al.

[11] Patent Number: 6,011,519

[45] Date of Patent: Jan. 4, 2000

[54] DIPOLE ANTENNA CONFIGURATION FOR MOBILE TERMINAL

[75] Inventors: Robert A. Sadler, Durham, N.C.; John M. Spall, Bedford, Tex.

[73] Assignee: Ericsson, Inc., Research Triangle Park, N.C.

[21] Appl. No.: 09/189,890

[22] Filed: Nov. 11, 1998

[51] Int. Cl.[7] ..... H01Q 1/24; H01Q 7/00; H01Q 21/00

[52] U.S. Cl. ..... 343/742; 343/702; 343/866; 343/867

[58] Field of Search ..... 343/742, 702, 343/866, 867, 741

[56] References Cited

U.S. PATENT DOCUMENTS

| | | | |
|---|---|---|---|
| 4,785,303 | 11/1988 | Clark et al. | 343/742 |
| 5,300,938 | 4/1994 | Maroun et al. | 343/702 |
| 5,451,965 | 9/1995 | Matsumoto | 343/866 |
| 5,508,709 | 4/1996 | Krenz et al. | 343/702 |
| 5,555,459 | 9/1996 | Kraus et al. . | |
| 5,561,437 | 10/1996 | Phillips et al. | 343/702 |
| 5,572,223 | 11/1996 | Phillips et al. | 343/702 |
| 5,905,467 | 5/1999 | Narayanaswamy et al. | 343/702 |

*Primary Examiner*—David H. Vu
*Assistant Examiner*—Jennifer H. Malos
*Attorney, Agent, or Firm*—Coats & Bennett, P.L.L.C.

[57] ABSTRACT

The present invention provides an internal antenna for mobile terminals that provides performance comparable with externally mounted antennas. The antenna is of a looped dipole configuration wherein the resonating elements of the antenna are integrated within or located on an inside or outside surface of the terminal's housing. The looped-shaped resonating elements may be placed around other components of the phone without significantly infringing on precious, physical space. For example, the loop elements may be placed around the keypad, around the display, around any portion or outline of the housing, and in a flip portion hingeably engaging a main section of the housing. Preferably, the antenna is a two-sided, half-wave antenna having two rectangular-shaped loop dipole elements.

29 Claims, 8 Drawing Sheets

DIPOLE ANTENNA CONFIGURATION FOR MOBILE TERMINAL

BACKGROUND OF THE INVENTION

The present invention relates to mobile terminals for use in analog and digital-based cellular communication systems, and, in particular, to an improved antenna configuration therefore. For clarity, the specification assumes that such mobile terminals include wireless communication devices, such as personal communication assistants, pagers, headsets, wireless modems, analog and digital cellular telephones, and the like, which are configured to operate in a wireless communication system where mobile terminals communicate via terrestrial and satellite base stations to any number of telephony systems.

Mobile terminals, and especially mobile telephones and headsets, are becoming increasingly smaller. These terminals require a radiating element or antenna for radio communications. Conventionally, antennas for such terminals are attached to and extend outwardly from the terminal's housing. These antennas are typically retractably mounted to the housing so that the antenna is not extending from the housing when the terminal is not in use. With the ever decreasing size of these terminals, the currently used external antennas become more obtrusive and unsightly, and most users find pulling the antenna out of the terminal housing for each operation undesirable. Furthermore, these external antennas are often subject to damage and breakage during manufacture, shipping and use. The external antennas also conflict with various mounting devices, recharging cradles, download mounts, and other cooperating accessories.

Thus, it would be beneficial if the external, outwardly extending antennas used for existing mobile terminals were replaced with an internal antenna providing comparable performance for both single and dual-mode operation. An internal antenna would require generally omni-directional performance without being affected by the terminal's electronics and analog and digital ground planes.

SUMMARY OF THE INVENTION

The present invention provides an internal antenna for mobile terminals that provides performance comparable with externally mounted antennas. The antenna is of a looped dipole configuration wherein the resonating elements of the antenna are integrated within or located on an inside or outside surface of the terminal's housing. The looped-shaped resonating elements may be placed around other components of the phone without significantly infringing on precious, physical space. For example, the loop elements may be placed around the keypad, around the display, around any portion or outline of the housing, and in a flip portion hingeably connected to a main section of the housing. Preferably, the antenna is a two-sided, half-wave antenna having two rectangular-shaped loop dipole elements.

Accordingly, the present invention relates to a mobile terminal with a non-obtrusive antenna, including communication electronics facilitating wireless communications, a housing enclosing the communication electronics, a dipole antenna having two resonating loop elements, and an antenna feed coupling the loop elements to the communication electronics. Each of the resonating loop elements is integral with and attached at substantially all points to a portion of the housing wherein the antenna does not substantially extend outward from the housing. Preferably, the antenna is either embedded in the thickness of the housing, attached to an inner surface of the housing, or attached to an outer surface of the housing.

Furthermore, additional conductive elements may be placed along the housing to provide tuning traces as well as an additional dipole antenna configured for operation at a different frequency than the first antenna. The terminal may be a single-body housing or a flip-type housing wherein one of the antenna loop elements is placed in the flip portion and the other element is placed in the main body of the housing. These and other aspects of the present invention will become apparent to those skilled in the art after reading the following description of the preferred embodiments when considered with the drawings.

DETAILED DESCRIPTION OF THE PREFERRED EMBODIMENTS

Figure 1:
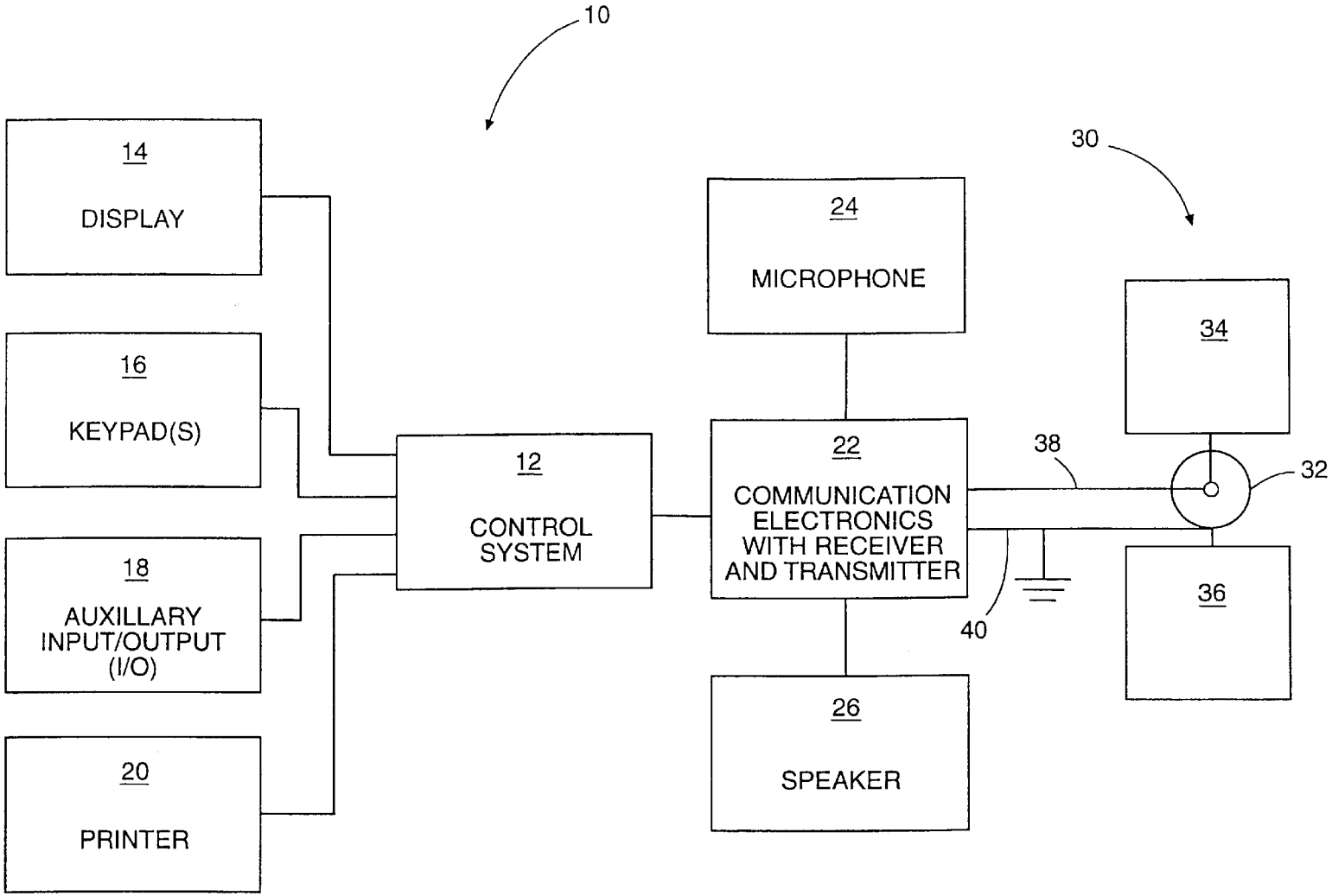
FIG. 1 is a block schematic of mobile terminal electronics including optional terminal features.

In the following description, like reference characters designate like or corresponding parts throughout the several figures. It should be understood that the illustrations are for the purpose of describing preferred embodiments of the invention and are not intended to limit the invention thereto.

With reference to FIG. 1, a schematic overview of a mobile terminal 10 is shown having various optional components. Generally, the terminal 10 will include a control system 12 associated with one or more of the following: a display 14, keypads 16, 17, auxiliary I/O device 18, or printer 20. As noted, each of these components are optional, and various ones or combinations thereof are present in different applications of a mobile terminal. For example, a telephone configuration will generally include a display 14 and one or more keypads 16. Auxiliary I/O 18, printing capability and any other desired features are optional.

The control system 12 is further associated with the necessary radio communication electronics 22, which invariably include a receiver and transmitter (except in certain pager applications) for providing wireless communications with other terminals or telephony systems directly or through base stations. In telephone embodiments, the radio communication electronics are associated with a microphone 24 for receiving audible voice signals and a speaker 26 to acoustically reproduce audible signals for the user.

The radio communication electronics 22 are associated with one or more dipole antennas 30 having two loop-shaped, resonating antenna elements. The first antenna element, which is coupled to the radio frequency signal transmission path 38, is referenced as RF loop 34, and the element associated with ground path 40 is referred to as ground loop 36. Each loop element 34, 36 is electrically coupled to the respective transmission path 38 or ground 40 via antenna feed 32.

Figure 2:
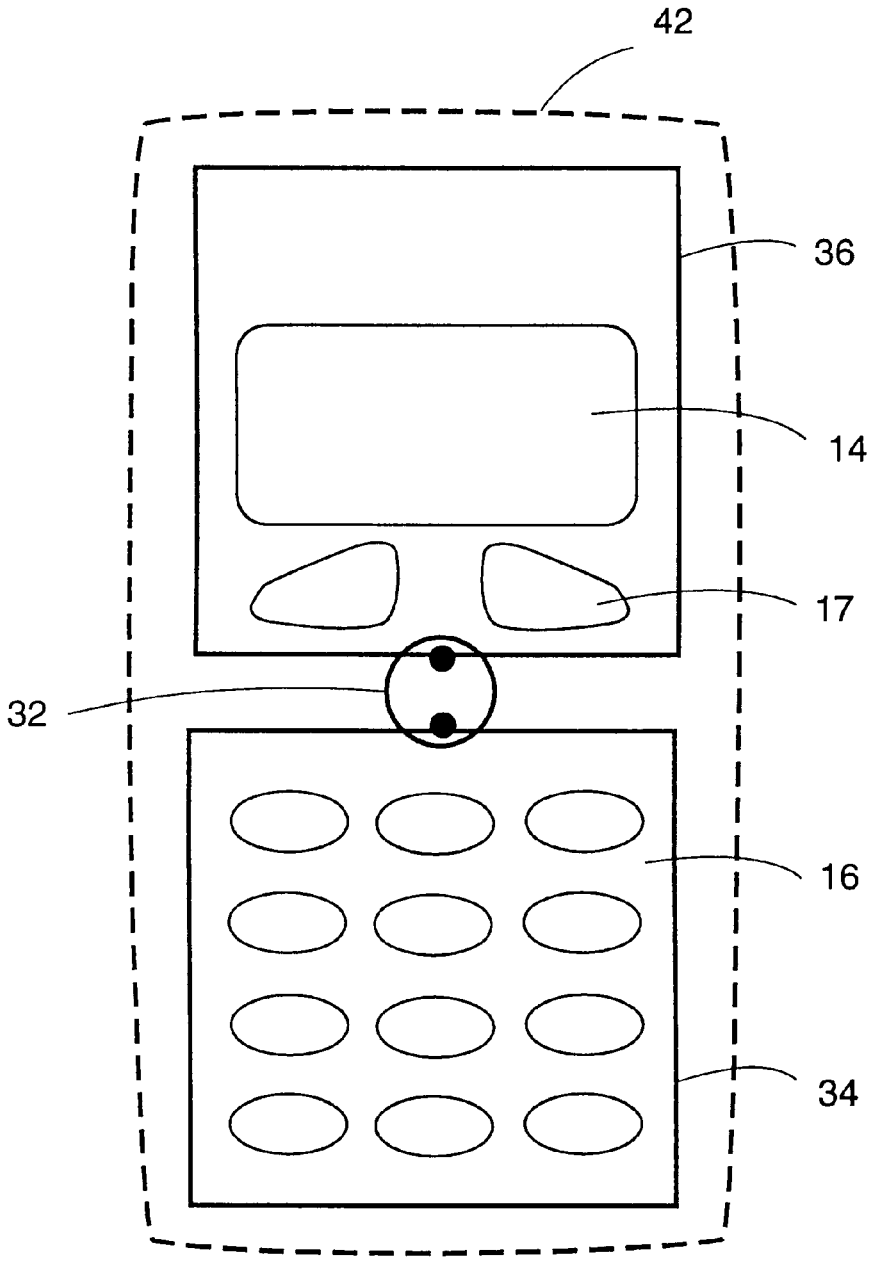
FIG. 2 is a front view of a telephone embodiment of a mobile terminal having an antenna constructed according to the present invention.

With reference now to FIG. 2, a telephone embodiment of a mobile terminal is shown with an integral dipole antenna depicted along the front face of housing 42. The front face includes keypad 16 and display 14 wherein the RF loop 34 surrounds the lower keypad 16, and the ground loop 36 surrounds the upper keypad 17 and display 14. Preferably, the RF and ground loops 34, 36 are configured to provide a half-wave dipole antenna. The elements forming the RF and ground loops 34, 36 may be placed on an outside or inside surface of the housing 42 or integrally molded within the housing wall between the outside and inside housing surface. The loop configuration of the antenna elements enhances performance of the antenna near ground planes found in the printed circuit boards making up the terminal's electronics.

Figure 3:
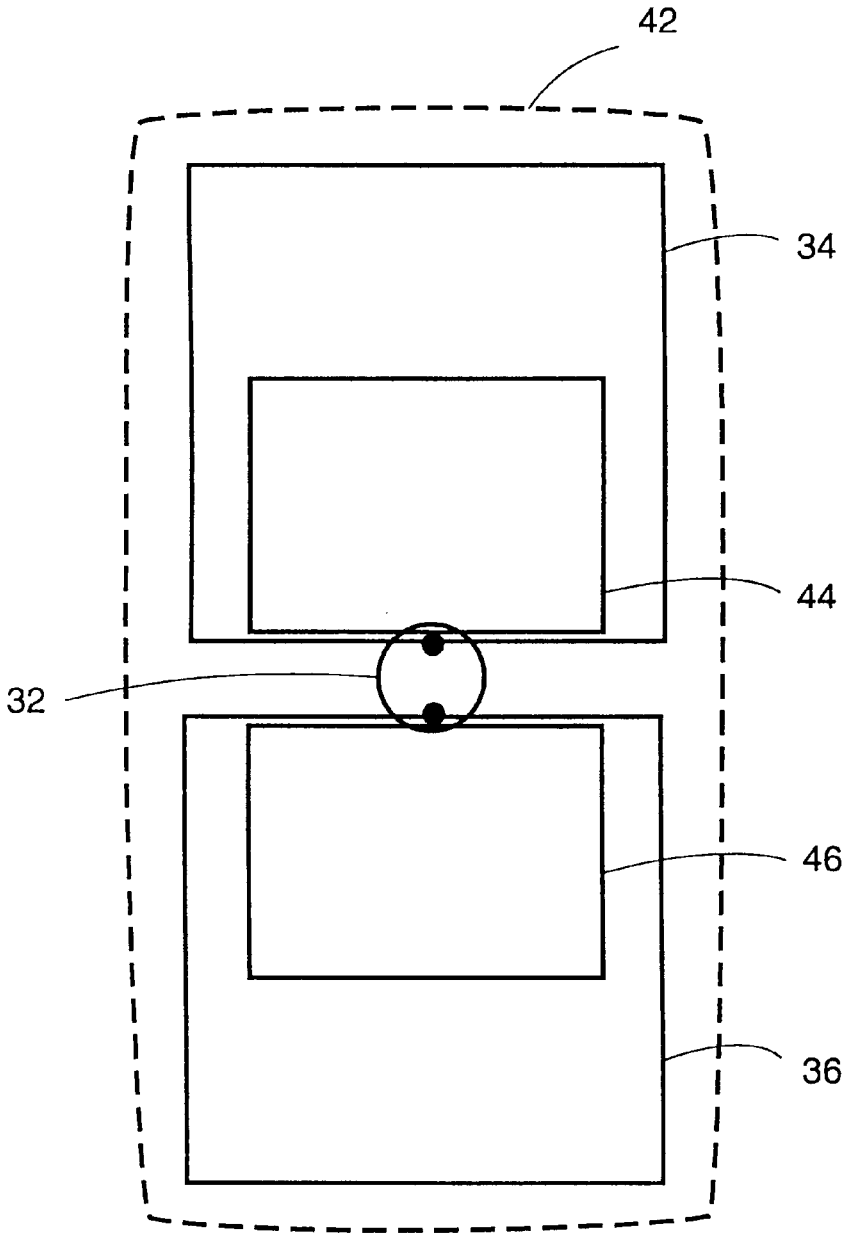
FIG. 3 is a mobile terminal having two dipole antennas for dual-frequency operation constructed according to the present invention.

In addition to placing the antenna loops on the front of a mobile terminal, virtually any surface of the mobile terminal may be used, including the back surface as shown in FIG. 3. Furthermore, an additional antenna having an RF loop 44 and a ground loop 46 may be placed on the terminal housing 42. The additional antenna may use the same or a different antenna feed 32. The RF and ground loops 44, 46 of the additional antenna will preferably be sized accordingly to provide a half-wave dipole antenna at an operating frequency different from the operating frequency for which the first antenna is configured. As such, any terminal can be configured for multi-band performance. Notably, any additional antennas and associated loop elements may be placed along any portion of the terminal housing 42 as long as the basic dipole configuration is maintained. For example, the antennas may be substantially concentrically aligned as shown in FIG. 3 or one antenna may be placed along one surface while the other antenna is placed on an adjacent or opposing surface. Furthermore, the loop elements of either antenna in a multi-band configuration may share portions of antenna elements or be configured completely exclusive to one another.

Figure 4:
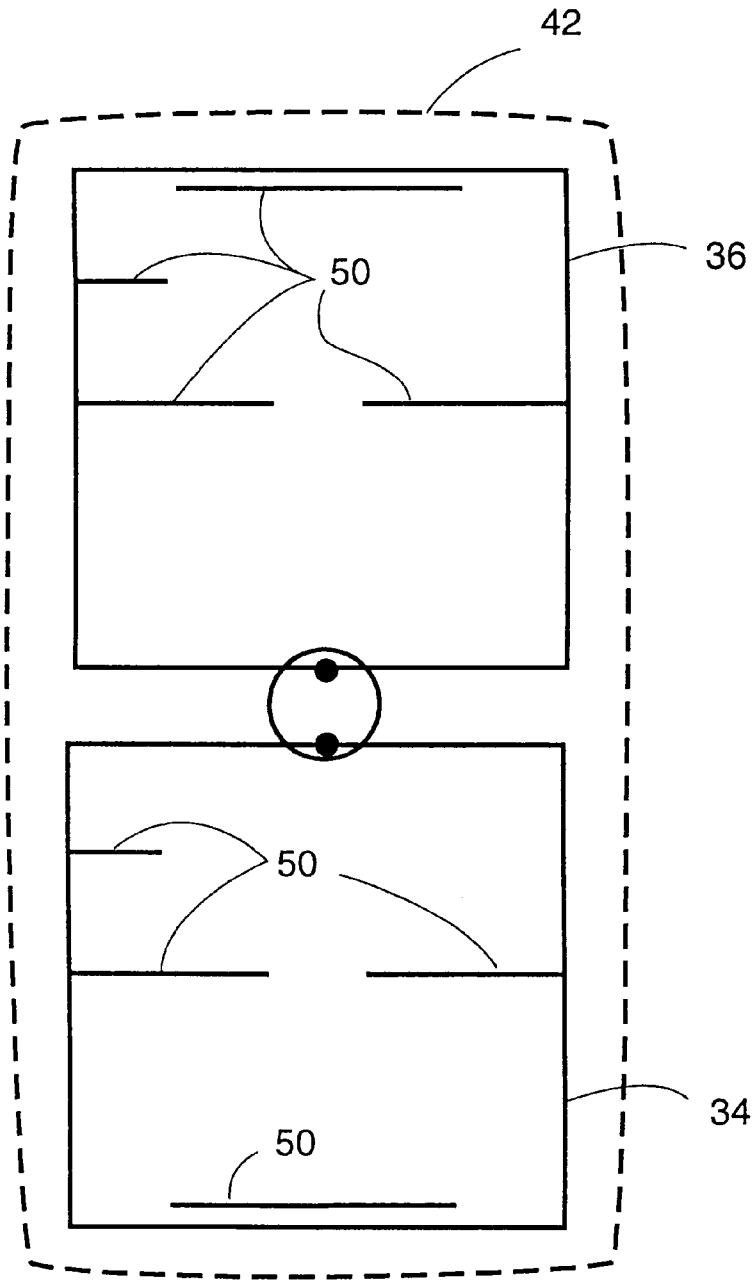
FIG. 4 is a mobile terminal having additional antenna elements associated with and/or connected to elements of the dipole antenna according to the present invention.

Turning now to FIG. 4, conductive tuning elements 50 are strategically placed for tuning and multi-band operation. These additional elements 50 may be electrically coupled to one or more points of one of the RF or ground loops 34, 36 or may be electrically isolated therefrom. These tuning elements 50 may be used to compensate for the shape or location of the antenna loops or the effects of components of the mobile terminal on antenna performance.

Figure 5:
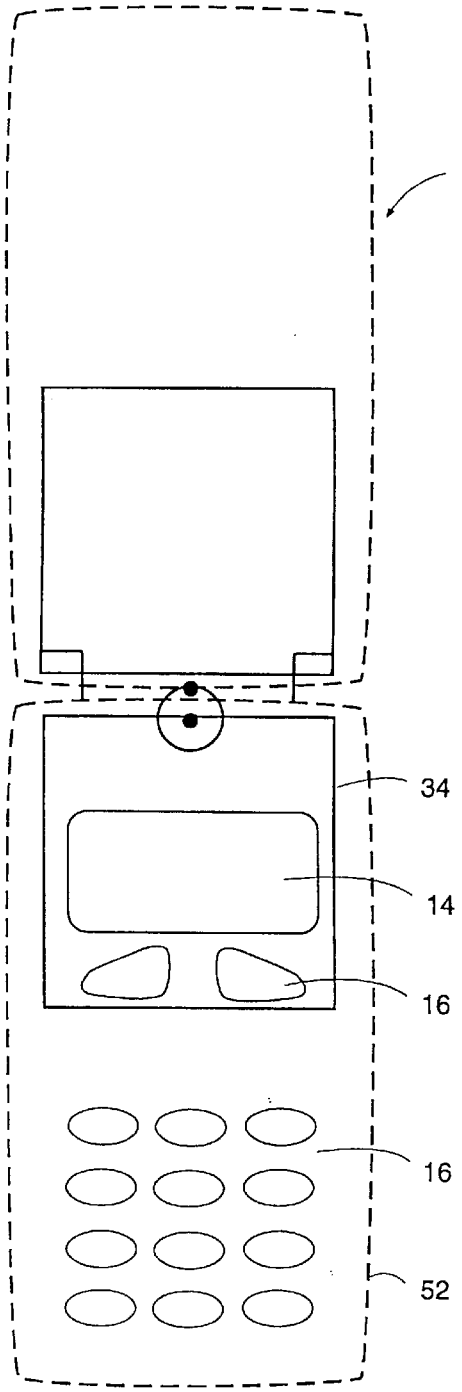
FIG. 5 is a front view of a top-mounted, flip-type mobile telephone wherein the dipole antenna is mounted along the front face of the telephone housing.
Figure 6:
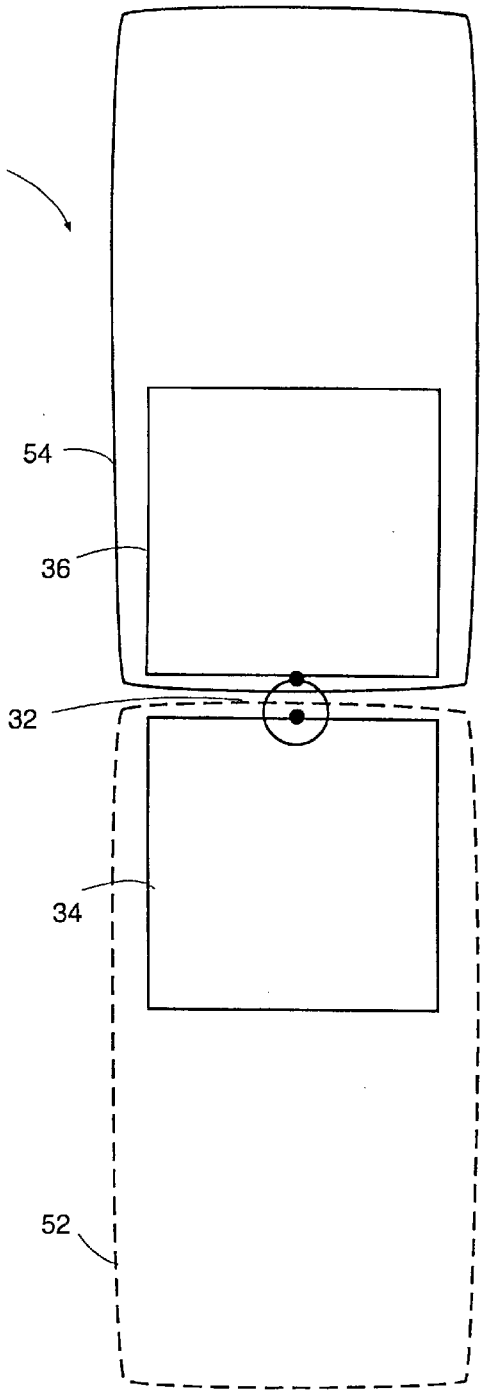
FIG. 6 is a back view of a top-mounted, flip-type mobile telephone wherein the dipole antenna is mounted along the back face of the telephone housing.

The integral dipole antenna of the present invention is particularly useful with flip-type mobile terminals. As shown in FIG. 5, a flip-type telephone embodiment includes a housing 42 with a main body 52 and a flip portion 54 hingeably connected to the main body 52. The RF loop 34 is provided on the main body 52 while the ground loop 36 is provided on the flip portion 54. In the stowed position, where the main body 52 and flip portion 54 are folded against each other (not shown), the antenna acts as a quarter-wave loop with degraded performance. When the flip portion is open, the loop dipole antenna is active. FIG. 6 shows an alternative embodiment of a flip-type telephone of FIG. 5 wherein the RF and ground loops 34, 36 forming the dipole antenna are located on the back of housing 42. The flip-type telephone shown in FIGS. 5 and 6 is typically referred to as top-mounted flip designs.

Figure 9:
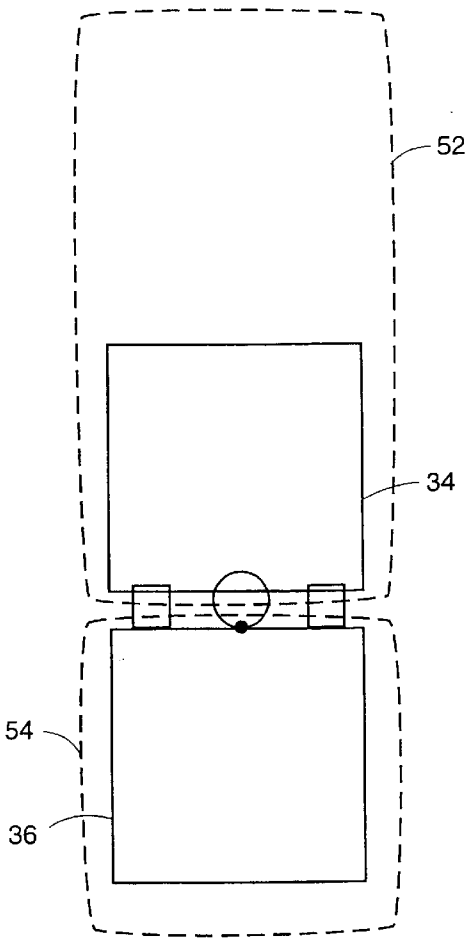
FIG. 9 is a back view of a bottom-mounted, flip-type mobile telephone shown in an open configuration with the antenna element mounted along the back face of the telephone housing.
Figure 8:
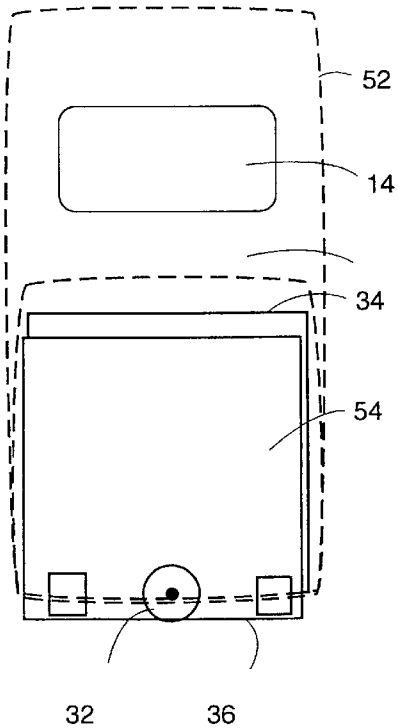
FIG. 8 is a front view of a bottom-mounted, flip-type mobile telephone shown in a closed configuration with the antenna element mounted along the front face of the telephone housing.
Figure 7:
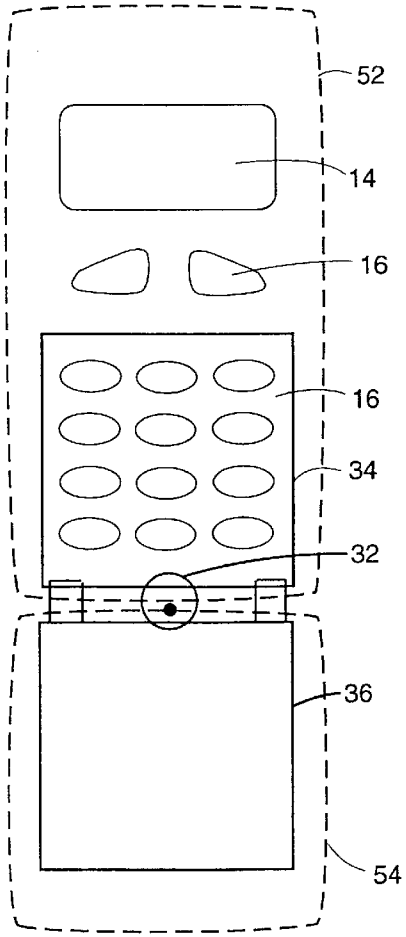
FIG. 7 is a front view of a bottom-mounted, flip-type mobile telephone shown in an open configuration with the antenna element mounted along the front face of the telephone housing.

FIGS. 7, 8 and 9 disclose a bottom-mounted flip-type telephone. Again, one antenna loop is placed on the main body 52 and the other loop is placed on the flip portion 54 of housing 42. Notably, either the RF or ground loop 34, 36 may be placed on either one of the main body 52 or flip portion 54. As with the other embodiments, the RF and ground loops 34, 36 may be placed on the front (FIGS. 7 and 8), on the back (FIG. 9), or along any other part of housing 42. Again, when the flip portions 54 having one of the RF or ground loops 34, 36 are open, full half-wave dipole antenna performance is achieved. When the flip portion 54 is closed against the main body 52, degraded quarter-wave performance is provided. Notably, the performance of the quarter-wave antenna is sufficient to at least initiate communications, such as receiving basic control signals from area base stations.

Figure 11:
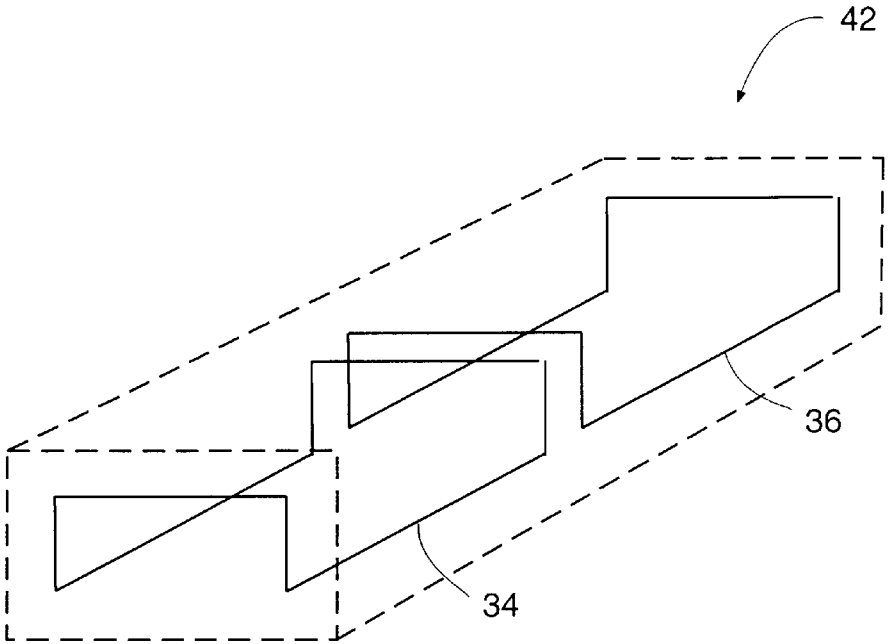
FIG. 11 is a perspective view of a mobile terminal housing wherein the loop elements of the dipole antenna conform about multiple sides of the terminal housing according to the present invention.
Figure 10:
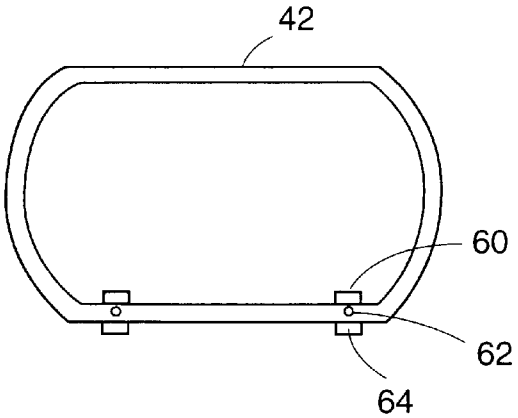
FIG. 10 is a cross-sectional view of a mobile terminal housing depicting the various mounting locations provided by the present invention.

FIG. 10 depicts a cross section of a housing 42 and identifies the various places along which a conductive element of an antenna loop or tuning element may be placed. Any such element may be placed on an inside surface of the housing 42 (60), within the housing 42 (62), or on an outside surface (64) of housing 42. Regardless of the placement along the housing, the traces may travel anywhere along housing 42 and about any components mounted thereto. Furthermore, as shown in FIG. 11, any of the antenna elements, including tuning elements 50, may take on a variety of shapes and follow a variety of contours, edges, or shapes provided by housing 42. The embodiment in FIG. 11 is exemplary of RF and ground loops 34, 36 following the elongated, rectangular housing depicted. Although the loop and tuning elements are shown as being linear in the drawing figures, any of these elements may curve in any variety of ways in order to accommodate the shape of the housing, placement of components on the housing, and provide desired performance. The antenna loops are preferably substantially rectangular, but may take on any looped structure, including symmetrical and asymmetrical elliptical and circular shapes.

Figure 13:
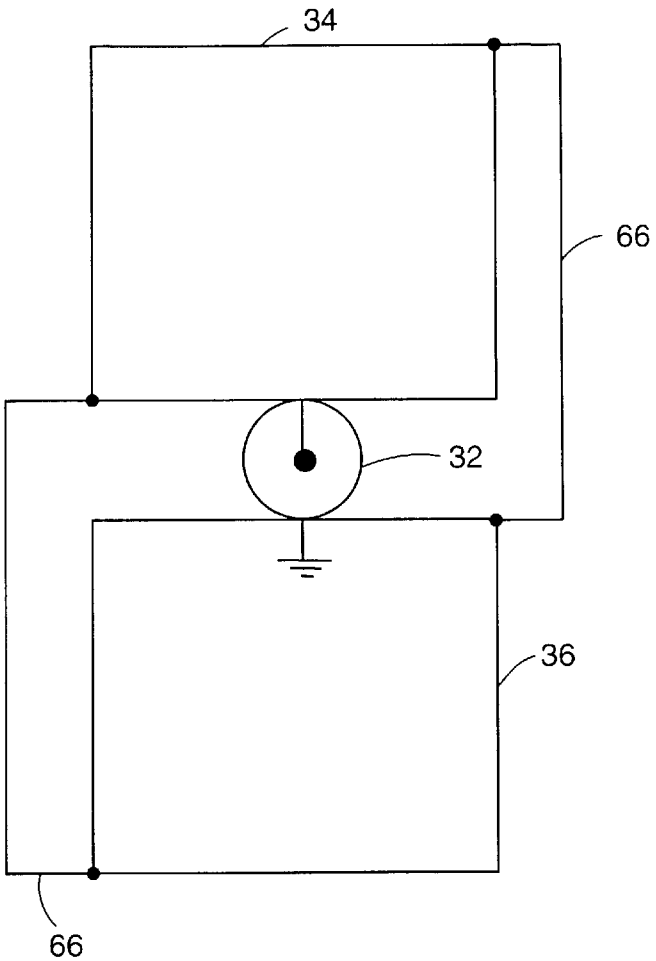
FIG. 13 is a schematic diagram of a loop dipole antenna having additional tuning loops according to the present invention.
Figure 12:
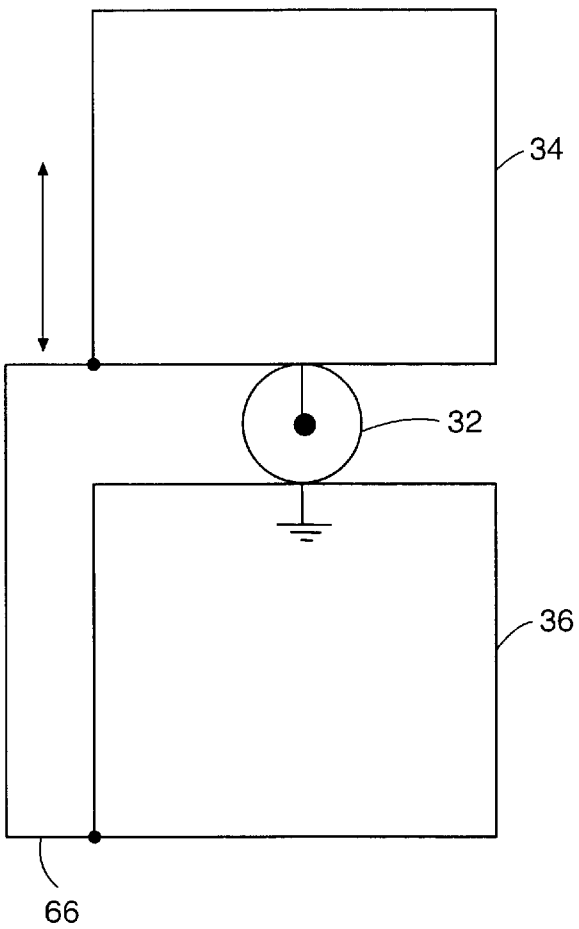
FIG. 12 is a schematic diagram of a loop dipole antenna having an additional tuning loop according to the present invention.

Additional loop elements 66 may be used to electrically couple the RF and ground loops 34, 36 to create a tuning loop, which may be used to tune the antenna to a desired frequency as well as provide reception characteristics sufficient to receive signals at multiple frequencies for multi-band performance FIG. 12. The tuning loop element 66 may be coupled to the ground and RF loops 34, 36 at various points for additional tuning. Additional loop elements 66 may be provided as shown in FIG. 13 for further tuning and impedance matching.

Any of the conductive elements forming the antenna loops or any of the tuning elements can be photo etched, plated or silk screened onto the terminal housing. Alternatively, such elements can be a conductive wire or trace that is molded or embossed within or into the housing. The loop elements and tuning elements may be symmetrical or asymmetrical for varied tuning effects. Each of these elements will include a sufficient dielectric layer to prevent direct contact of any conductive element. Furthermore, the components, which any loop is associated with or surrounds, may include a dielectric that can be varied to further affect tuning. For example, the dielectric of a keypad may be modified to affect tuning for an antenna loop proximate thereto.

Those skilled in the art will recognize variations on the themes disclosed herein. Such themes are considered within the scope of the disclosure and the claims that follow. As such, variations obvious to those skilled in the art relating to integrating a looped dipole antenna in or to a terminal housing to provide highperformance reception and transmission in close proximity to a ground plane is considered within the scope of the present invention. Certain modifications and improvements will occur to those skilled in the art upon reading the foregoing description. It should be understood that all such modifications and improvements have been omitted for the sake of conciseness and readability, but are properly within the scope of the following claims.

We claim:

1. A mobile radio communication device comprising:

a. communications electronics for engaging in wireless communications;

b. a housing enclosing said communication electronics, said housing including a main body and a flip portion; and c. a dipole antenna having two resonating loop elements and an antenna feed coupling to said communication electronics, each said resonating loop element being integral with and conforming to said main body.

2. The mobile terminal of claim 1 wherein said resonating loop elements are positioned adjacent one another and along said housing in a dual-sided, looped dipole antenna configuration.

3. The mobile terminal of claim 2 wherein said housing includes a front surface and wherein both of said loop elements are disposed along said front surface of said housing.

4. The mobile terminal of claim 2 wherein said housing includes a back surface and both of said loop elements are disposed along said back surface of said housing.

5. The mobile terminal of claim 2 wherein one of said loop elements is disposed along a front surface of said housing and the other of said loop elements is disposed along a back surface of said housing.

6. The mobile terminal of claim 1 wherein said loop elements are substantially rectilinear.

7. The mobile terminal of claim 1 wherein said housing includes a user interface and wherein one said loop element encircles at least a portion of said user interface.

8. The mobile terminal of claim 7 wherein said user interface includes a keypad and wherein one of said loop elements extends around said keypad.

9. The mobile terminal of claim 7 wherein said user interface includes a display and wherein one of said loop elements extends around said display.

10. The mobile terminal of claim 1 wherein said loop elements conform to an outer surface of said housing.

11. The mobile terminal of claim 1 wherein said loop elements conform to an inner surface of said housing.

12. The mobile terminal of claim 1 wherein said loop elements are encapsulated within a wall forming a portion of said housing.

13. The mobile terminal of claim 12 wherein said loop elements are molded into said housing.

14. The mobile terminal of claim 1 wherein said loop elements are substantially symmetrical.

15. The mobile terminal of claim 1 wherein said loop elements are asymmetrical.

16. The mobile terminal of claim 1 wherein an additional antenna element is electrically coupled to at least one said loop elements to affect antenna tuning.

17. The mobile terminal of claim 16 wherein an additional antenna element is electrically coupled between said loop elements to affect antenna tuning.

18. The mobile terminal of claim 16 wherein said loop elements are substantially rectilinear and said additional antenna element provides a tuning loop affecting antenna tuning.

19. The mobile terminal of claim 1 further comprising a second dipole antenna having two resonating loop elements and an antenna feed coupling said loop elements of said second dipole antenna to said communication electronics, each said resonating loop elements being integral with said housing, wherein said first and second dipole antennas are configured to operate at different frequencies.

20. The mobile terminal of claim 19 wherein said first and second dipole antennas are concentrically arranged.

21. The mobile terminal of claim 1 wherein said main body includes a keypad and a display, and wherein one of said loop elements extends around said keypad and one of said loop elements extends around said display.

22. A mobile radio communication device comprising:

a. communications electronics for engaging in wireless communications;

b. a housing enclosing said communication electronics and including a display; and c. a dipole antenna having two resonating loop elements and an antenna feed coupling to said communication electronics, each of said resonating loop elements being integral with and conforming to said housing, one of said resonating loop elements positioned around said display.

23. The mobile terminal of claim 22 wherein said housing includes a main body and a flip portion pivotally connected to said main body, wherein said flip portion is moveable between a first position extending outward from said main body and a second position against said main body, the other of said loop elements being integral with and conforming to said flip portion such that a dual-sided, looped dipole antenna configuration is formed when said flip portion is in said first position.

24. The mobile terminal of claim 22 wherein said housing includes a main body and a flip portion pivotally Connected to said main body, both of said loop elements positioned within the main body.

25. The mobile terminal of claim 24 wherein the main body includes a keypad and wherein the other of said loop elements is positioned around said keypad.

26. A mobile radio communication device comprising:

a. communications electronics for engaging in wireless communications;

b. a housing enclosing said communication electronics;

c. a dipole antenna having two resonating loop elements and an antenna feed coupling to said communication electronics, each said resonating loop element being integral with and conforming to said housing; and d. wherein said housing includes a keypad and wherein one of said loop elements extends around said keypad.

27. The mobile terminal of claim 26 wherein said housing includes a main body and a flip portion, said flip portion pivotally connected to said main body, and wherein both of said resonating loop elements are positioned within said main body.

28. The mobile terminal of claim 26 wherein said housing includes a main body and a flip portion pivotally connected to said main body, wherein said flip portion is moveable between a first position extending outward from said main body and a second position against said main body, the other of said loop elements being integral with and conforming to said flip portion such that a dual-sided, looped dipole antenna configuration is formed when said flip portion is in said first position.

29. The mobile terminal of claim 26 wherein said housing includes a display and wherein the other one of said loop elements extends around said display.

* * * * *